US005624007A

United States Patent [19]

Mahaffy

[11] Patent Number: 5,624,007

[45] Date of Patent: Apr. 29, 1997

[54] TREE STEP INSERTION AND REMOVAL DEVICE

[76] Inventor: Marvin Mahaffy, 23635 E. Main St., Armada, Mich. 48005

[21] Appl. No.: 570,913

[22] Filed: Dec. 12, 1995

[51] Int. Cl.[6] ..... A63B 27/00; A63B 29/04

[52] U.S. Cl. ..... 182/92; 182/90

[58] Field of Search ..... 182/90, 92; 81/119, 81/125, 488

[56] References Cited

U.S. PATENT DOCUMENTS 3,298,459 1/1967 Bergsten ..... 182/92

4,697,669 10/1987 Bergsten ..... 182/92

*Primary Examiner*—Alvin C. Chin-Shue

*Assistant Examiner*—Long D. Phan

*Attorney, Agent, or Firm*—Young & Basile

[57] ABSTRACT

A device is disclosed for the insertion and removal of rod-type tree steps having vertically spaced apart first and second horizontally disposed sections extending oppositely from a vertically disposed central section. The device has a body portion including a handle and an opening for removably receiving therein the second section of the tree step. A lock member is selectively positionable with respect to the body portion so as to intrude into the opening therein and restrain unwanted movement of the second section of the tree step. A guide slot provided adjacent the upper and of and opening away from the body portion removably captures the central section of the tree step.

13 Claims, 2 Drawing Sheets

TREE STEP INSERTION AND REMOVAL DEVICE

FIELD OF THE INVENTION

The device of the present invention relates generally to tree steps and more particularly to a device providing for the insertion and removal of rod-type tree steps.

BACKGROUND

Many outdoor recreational activities require an individual to perch himself, or other objects, well above the ground. In deer hunting, for example, trees frequently provide the best means available to a hunter for avoiding early detection by his prey.

But a hunter's desire to use the natural protection and cover afforded by a tree can be quite separate from his ability to climb it. For example, a hunter will often times be so overburdened with equipment that scaling a tree is virtually impossible. To this end, many hunters and other outdoor sports persons use a device commonly known as a tree step.

The typical rod-type tree step is a simple, unitary steel rod having an open "Z" shape characterized by first and second substantially horizontal sections extending in opposite directions from either end of a centrally disposed, vertically oriented section. One horizontal section includes a threaded screw portion for insertion into a tree. The second, opposing section comprises the "step", which usually includes a non-skid surface that provides traction during climbing.

Insertion of the tree step is accomplished by screwing the threaded portion into the tree. Because the second, step section also acts as a handle for the user during the insertion process, it will be appreciated that the open "Z" configuration of the step is also beneficial. Since the "step" section is offset with respect to the axis of insertion of the threaded portion, the "step" section imparts greater rotational force, or torque, during insertion, making installment of the tree step less tiresome.

Unfortunately, the geometric configuration of the typical tree step is not sufficient to prevent the onset of fatigue in instances where a great number of tree steps must be inserted or removed. Nor is the increased rotational torque provided by its open "Z" shape sufficient to overcome particularly dense wood without great physical exertion.

Several apparent limitations prevent simple modification of existing tree steps to overcome the above problems. In the first place, increasing the rotational force imparted on the axis of insertion would require an increase in the length of the tree step's vertically oriented section. But this solution increases the size and weight of each tree step, reducing the number that can be carried by an individual. Secondly, the desire for the tree step to be operable by a single user prevents the distance between the "step" and threaded sections from exceeding the arm span of the average person.

SUMMARY OF THE DISCLOSURE

It is an object of the present invention, therefore, to provide a device for the efficient installation and removal of tree steps.

Another object of this invention is to provide a device separate and distinct from an individual tree step, such that only a single device according to the present invention is necessary to install or remove any desired number of tree steps.

Yet a further object of the present invention is to provide for the less tiresome insertion and removal of tree steps.

These and other objects of the present invention are accomplished by a device for the insertion and removal of rod-type tree steps of the type having vertically spaced-apart first and second horizontally disposed sections extending oppositely from a vertically disposed central section. The inventive device itself comprises a body portion including an opening for removably receiving therein the second section of the tree step, first retention means for removably capturing the central section of the tree step, second retention means for selectively restraining the second section of the step within the opening, and a handle.

According to one feature of the present invention, the body portion is vertically elongate and has upper and lower ends. The first retention means comprise a semi-cylindrical guide slot opening away from the body portion. Also according to this feature, the second retention means comprise a bore in communication with the opening, and a retention member selectively positionable within both the bore and the opening, in order to prevent unwanted movement of the tree step within the opening.

According to another feature of the present inventive tree step insertion and removal device, the body portion further includes a head member disposed adjacent the upper end. According to this feature, the guide slot is integral with the head member.

According to yet another feature of the present invention, the handle comprises a fixed handle member projecting away from the body portion in a direction substantially perpendicular with respect to the longitudinal axis of the body portion.

These and additional features of this invention will be more fully understood with reference to the drawings and specification included hereinbelow.

DESCRIPTION OF THE ILLUSTRATED EMBODIMENT

Figure 1:
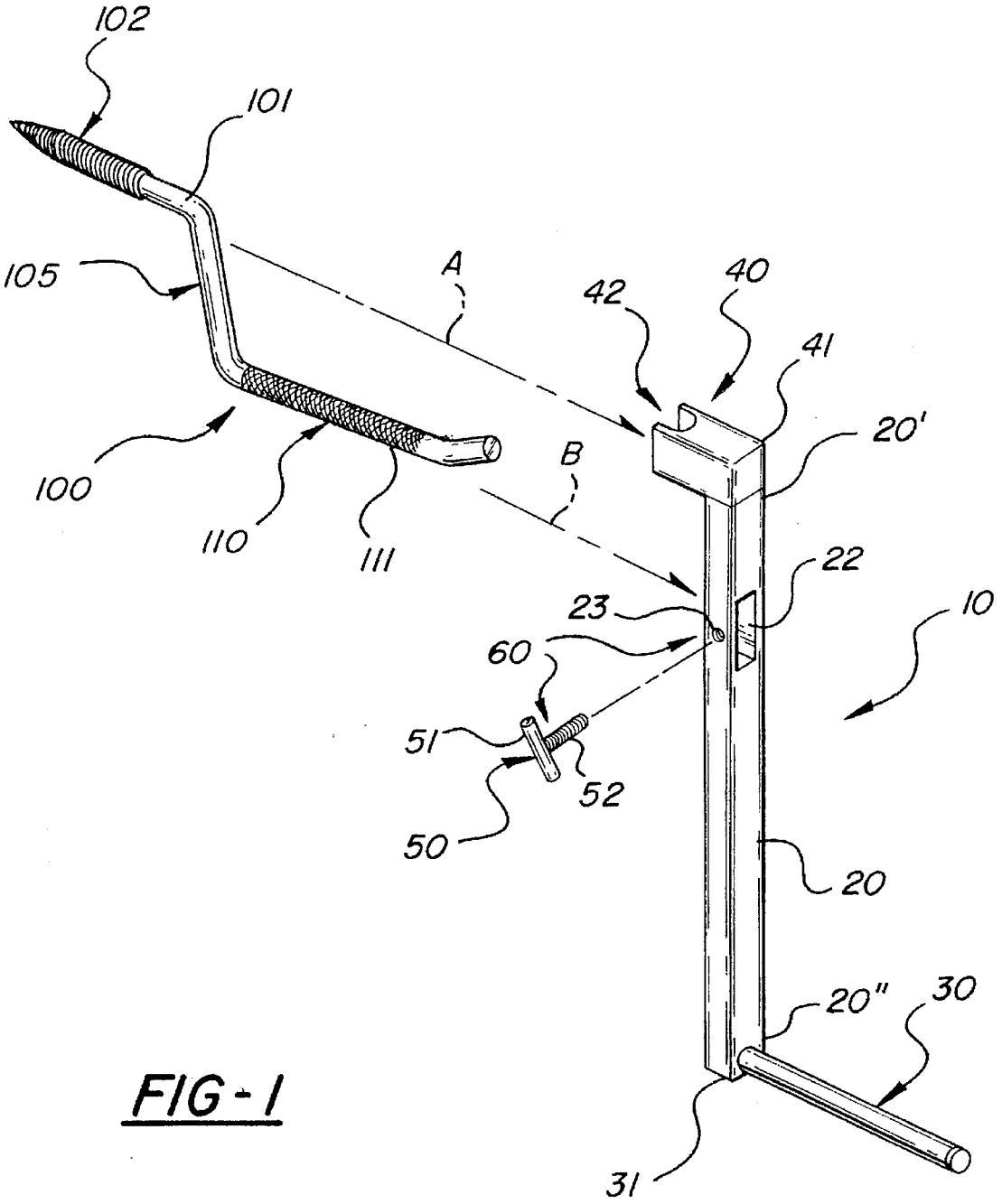
FIG. 1 is an exploded perspective view of the present invention, with a typical tree step illustrated therewith in an unassociated configuration.

The device 10 of the present invention comprises a hand-operable tree step insertion and removal tool including a body portion 20 having upper 20' and lower 20" ends and an opening 22 therein, a handle member 30, first retention means 40, and second retention means 60. As illustrated in FIG. 1, body 20 is vertically elongate and characterized by a substantially uniform rectangular cross-section over its principal length. Body 20 is preferably manufactured from steel, which is desirable for its characteristic strength and durability. In the illustrated form, body 20 is of unitary construction and is formed according to known milling or die-mold techniques. Alternately, body 20 may be formed separately and assembled according to known methods. Opening 22 extends between two, opposing surfaces of body portion 20 to define a passageway therethrough. As shown, the orientation of opening 22 is parallel with the orientation of handle 30. As explained in greater detail below, opening 22 is of dimensions sufficient to receive a portion of a rod-type tree step having a given diameter. In the illustrated form, opening 22 is characterized by rectangular dimensions. Opening 22 is preferably located near the upper end 20' of body portion 20, such that the distance between guide slot 41 and opening 22 correspond approximately with the length of the central section 105 of a tree step 100.

Handle 30, disposed from lower end 20", extends approximately perpendicularly away from the longitudinal axis of body 20. As shown, handle 30 is of unitary construction, simply comprising a desired length of steel rod affixed at one end 31 thereof proximate lower end 22". Of course, it will be evident to those skilled in the art that handle 30 could, alternatively, be of a more sophisticated construction; being, for example, rotatably fixed to handle 30.

First retention means 41 comprise, as shown, a guide slot 42 oriented adjacent upper end 20' of body portion 20. The opening of guide slot 42 is directed away from body 20 and, as explained further herein, is preferably configured as a semi-cylindrical groove. In the preferred embodiment, upper end 20' of body portion 20 further includes head 40 fixedly disposed thereon and extending perpendicularly away from the longitudinal axis of body 20. Head 40 is preferably formed from a single billet of steel and includes a substantially uniform shape characterized by a rectangular cross-section. Head 40 shares at least a first horizontal dimension with body 20. When mounted to body 20, this configuration permits at least three exterior sides of both body 20 and head 40 to share substantially flush, continuous surfaces. Alternately, head member 40 may be integrally formed with body 20, according to known techniques. However, head 40 is not critical and guide slot 42 may alternatively be formed integral with body portion 20 itself adjacent upper end 20' thereof.

Figure 3:
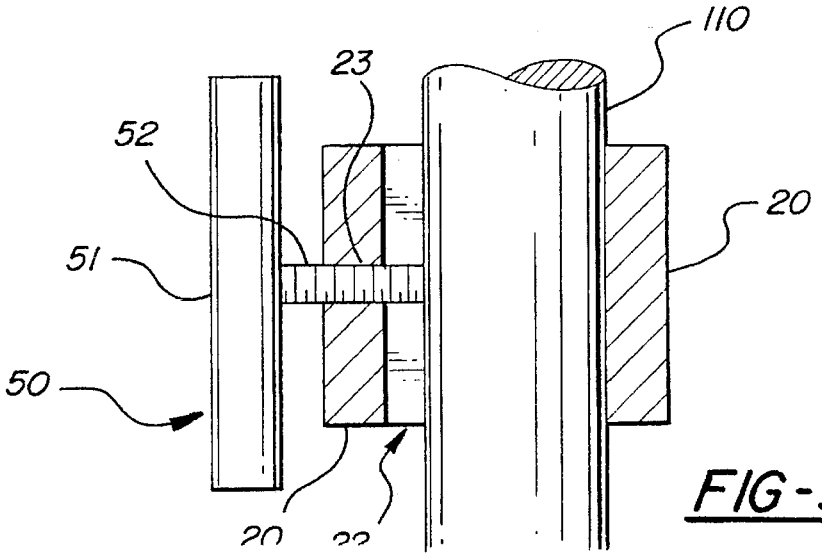
FIG. 3 is a transverse cross-section of the present invention, detailing the second retention means.

Referring now to FIG. 3, both the structure and function of second retention means 60 will be more fully understood. Second retention means 60 comprises a lock member 50 selectively positionable within a threaded bore 23 extending through a side of body 20 and communicating with opening 22. Lock member 50 comprises a threaded "T" screw 52 having a handle 51 perpendicularly disposed at one end thereof. As shown, the orientation of bore 23 is approximately perpendicular with respect to the longitudinal axis of body 20. In operation, retention member 50 is selectively positionable within bore 23 so as to intrude into opening 22 when a portion of a rod-type tree step 110 is received therein. Since it is preferable to provide opening 22 with dimensions accommodating to rod-type tree steps of varying diameters, some portion of the interior volume of the opening may remain unoccupied. However, unwanted lateral movement of rod-type tree step 100 during operation of the present invention must also be limited in order to facilitate the rod-type tree step insertion and/or removal process. Therefore, second retention means 60 serve to restrain movement of tree step section 110 by forcing it against the opposing side of body 20. For this reason, bolt 52 should be of sufficient length to exert such restraining force on tree steps of varying diameters.

Figure 2:
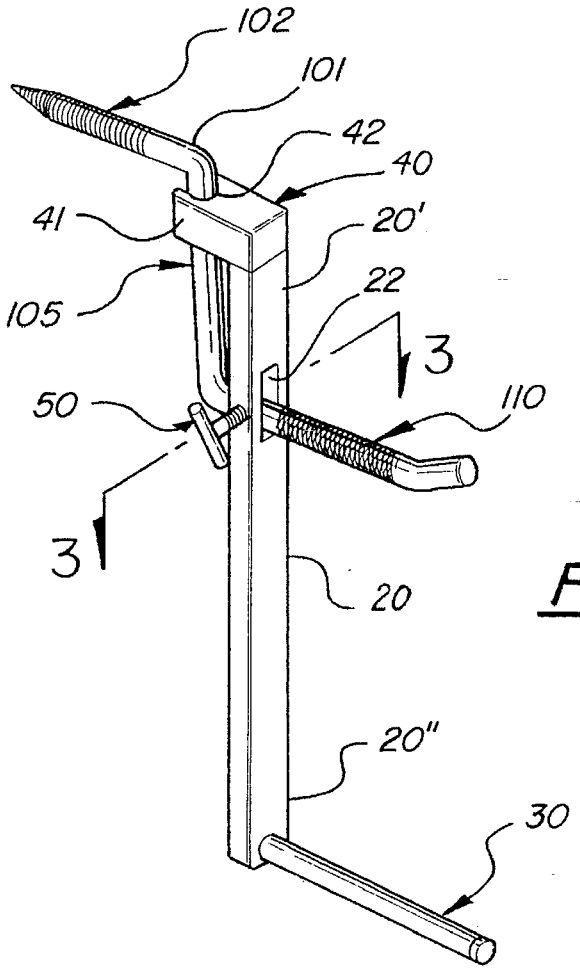
FIG. 2 is a perspective view illustrating the present invention and the tree step of FIG. 1 in association.

Referring again to FIGS. 1 and 2, operation of the present invention will be better understood. A typical rod-type tree step 100, which does not comprise any part of the present invention, is a unitary steel rod bent during manufacture to define a generally open "Z" configuration. As previously described, this shape is characterized by vertically spaced apart first 101 and second sections 110 extending oppositely from a vertically disposed central section 105. First section 101 includes a threaded portion 102 which is threadingly insertable into a tree. Second section 110 comprises the "step" portion of the tree step 100 and includes a non-slip surface 111 (typically comprising a gnurled rubber sleeve or "cross-hatch" type etchings integral to the steel rod itself).

Second section 110 is inserted through opening 22 (identified by line B) until a portion of central section 105 is captured within guide slot 41 in head member 40 (identified by line A). Lock member 50 is then positioned within bore 23 as described above to retain section 110 of the rod-type tree step 100 within position in opening 22.

With the rod-type tree step thus immobilized, the threaded region 102 of first section 101 is inserted into a tree by rotating device 10 in the appropriate direction with respect to its axis of insertion of tree step 100 (which is coaxial with the longitudinal axis of first section 101). This process may be commenced by gripping the rod-type tree step directly behind threaded portion 102 and rotating device 10 about the axis of insertion through operation of handle 30.

It will be appreciated from the foregoing that one benefit of the present invention is derived from the length of body portion 20 relative to the axis of insertion of the tree step 100. As the distance between handle 30 and the axis of insertion is increased, the rotational force which a user may exert upon the tree step 100 is correspondingly increased. Consequently, the tree step may be inserted or removed from a tree with less effort being expended by a user. Of course, the distance may be varied according to individual preference. But in the preferred form it is such as to permit a single user to easily manually operate the present inventive device 10, as explained above.

Of course, it is understood that the above is only illustrative of the present invention. Numerous modifications, apparent to those of ordinary skill in the art, are certainly possible without departing from the spirit and broader aspects of the invention as set forth in the appended claims.

The invention in which an exclusive property or privilege is claimed is defined as follows:

1. A tree step insertion and removal device for use in conjunction with rod-type tree steps having vertically spaced-apart first and second horizontally disposed sections extending oppositely from a vertically disposed central section, said tree step insertion and removal device comprising:

a body portion including an opening for removably receiving therein said second section of said tree step, first retention means for removably capturing said central section of said tree step, second retention means for selectively restraining said second section of said rod-type tree step within said opening, and a handle.

2. A tree step insertion and removal device for use in conjunction with rod-type tree steps having vertically spaced-apart first and second horizontally disposed sections extending oppositely from a vertically disposed central section, wherein said first horizontally disposed section is insertable within a tree, said tree step insertion and removal device comprising:

a body portion having upper and lower ends, and an opening for removably receiving therein said second section of said tree step;

a handle provided proximate said lower end;

first retention means for removably capturing said central section of said tree step, said first retention means comprising a semi-cylindrical guide slot disposed proximate said upper end; and second retention means for selectively restraining said second section of said tree step within said opening, said second retention means comprising a bore in communication with said opening, and a retention member selectively positionable within both said bore and said opening.

3. The device of claim 2, wherein said body portion further includes a head member disposed adjacent said upper end of said body portion.

4. The device of claim 3, in which said guide slot is integral with said head member.

5. The device of claim 2, wherein said handle comprises a fixed handle member projecting away from said body portion in a direction substantially perpendicular with respect to the longitudinal axis of said body portion.

6. A tree step insertion and removal device for use in conjunction with rod-type tree steps having vertically spaced-apart first and second horizontally disposed sections extending oppositely from a vertically disposed central section, said tree step insertion and removal device comprising:

a body portion having an opening therein for removably receiving at least one of said sections of said tree step; and a retention member to restrain said at least one of said sections of said tree step within said opening.

7. The tree step insertion and removal device of claim 6, further including first retention means for removably capturing said tree step.

8. The tree step insertion, and removal device of claim 7, wherein said body portion, further includes a bore in communication with said and said retention member comprises a screw threadingly receivable within said bore.

9. The tree step insertion and removal device of claim 8, wherein said second section of said tree step is removably received within said opening, and said first retention means comprise a guide slot removably capturing therein said central section of said tree step.

10. The tree step insertion and removal device of claim 9, wherein said body portion further includes a head member having said guide slot defined integrally therewith.

11. The tree step insertion and removal device of claim 10, wherein said guide slot is characterized by a semi-cylindrical cross-section.

12. The tree step insertion and removal device of claim 11, further including a handle fixed to said body portion and projecting away therefrom.

13. The tree step insertion and removal device of claim 12, wherein said body portion comprises an elongate member having upper and lower ends, said handle being fixed proximate said lower end and projecting away from said body portion in a direction substantially perpendicular with respect to the longitudinal axis of said body portion.

* * * * *

UNITED STATES PATENT AND TRADEMARK OFFICE

CERTIFICATE OF CORRECTION

PATENT NO. : 5,624,007

DATED : April 29, 1997

INVENTOR(S) : Mahaffy

It is certified that error appears in the above-indentified patent and that said Letters Patent is hereby corrected as shown below:

Title page, item ]57],

In the Abstract, delete "upper and" and insert --upper end--;

Column 6, line ], delete "with said and" and insert --with said opening, and--;

Column 5, line 25, delete "said body portion, further" and insert --said body portion further--.

Signed and Sealed this

Twenty-ninth Day of July, 1997

Bruce Lehman

*Attest:*

BRUCE LEHMAN

*Attesting Officer*

*Commissioner of Patents and Trademarks*